United States Patent [19]

Kurzen

[11] Patent Number: 4,635,411

[45] Date of Patent: Jan. 13, 1987

[54] CONSTRUCTION PANEL SYSTEM

[76] Inventor: Aaron Kurzen, Box 3233, Stony Creek, Conn. 06405

[21] Appl. No.: 503,351

[22] Filed: Aug. 9, 1983

Related U.S. Application Data

[63] Continuation of Ser. No. 196,208, Oct. 14, 1980, abandoned.

[51] Int. Cl.[4] ..... A63H 33/10

[52] U.S. Cl. ..... 52/71; 24/153; 273/155; 446/487; 446/112; 446/122

[58] Field of Search ..... 446/111, 86, 112, 122, 446/487; 273/155; 24/477, 470, 458, 153 R, 96, 30.5 S, 30.5 P, 30.5 R, 17 A, 17 AP, 16 PB; 52/71, 70

[56] References Cited

U.S. PATENT DOCUMENTS

| | | | |
|---|---|---|---|
| 2,245,875 | 6/1941 | Rutherford | 273/155 |
| 2,367,381 | 1/1945 | Szymlek | 40/155 |
| 3,487,578 | 1/1970 | Suderman | 273/155 |
| 3,654,052 | 4/1972 | Rye | 46/111 |
| 3,874,034 | 4/1975 | Clayton | 24/30.5 P |
| 3,922,758 | 12/1975 | Wunnenberg | 24/16 PB |
| 4,212,130 | 7/1980 | Walker | 46/112 |

FOREIGN PATENT DOCUMENTS

| | | | |
|---|---|---|---|
| 903599 | 9/1962 | United Kingdom | 24/30.5 P |

*Primary Examiner*—John E. Murtagh

*Attorney, Agent, or Firm*—Orville N. Greene; Frank L. Durr

[57] ABSTRACT

The disclosure relates to a construction panel system for the erection of doll and play houses, mazes, etc., and comprises a series of connected rectangular panels of approximately the same size connected together so that each panel can be rotated with respect to an adjacent panel but at least two of said panels are connected to adjacent panels by double hinges of the Jacobs ladder type so that they can be rotated in two directions with respect to adjacent panels and at least one additional panel is connected to the Jacobs ladder type so that it can be rotated in two directions with respect to said adjacent panel and at least one additional panel as connected to the Jacobs ladder panels by a hinge having its axis at right angles to the Jacobs ladder hinge. The panels are provided with holes adjacent the corners thereof and a fastening and reinforcing means is provided for holding non-connected panels together. The fastening and reinforcing means is made of planar, resilient flexible material and has a long central finger and two side fingers, the long central finger is somewhat wider than the diameter of the holdes in the panels and can be forced through a hole in a panel to attach to the panel with the side fingers limiting and supporting the central finger.

2 Claims, 17 Drawing Figures

CONSTRUCTION PANEL SYSTEM

This is a continuation of Application Ser. No. 196,208 filed Oct. 14, 1980, now abandoned.

This invention is a further development of the double-hinged, modular panel system disclosed in my U.S. Pat. No. 3,921,348 of Nov. 25, 1975 now aband.

That patent discloses a structural panel system suitable for making playhouses and mazes in play areas which includes a series of panels, a central one of which has a frame structure adapted to be supported in upright position, by a pole supported in an opening extending into the frame at an edge of the panel. Additional panels are connected to the central panel by double hinges which hinges are generally formed of the same material as said additional panels. The double hinge connections of the additional panels to the central panel enable the panels to be rotated about either side edge of the central panel.

One feature of the present invention is based on the discovery that additional construction capabilities of a Jacobs ladder type panel can be increased by adding panels to the struture which are capable of rotating about an axis or edge which is at right angles to the axis or edge for rotation of one or more Jacobs ladder panel pairs.

Another feature of the invention is based on the development of novel means for reinforcing and supporting the manipulated panels in the desired position.

Among the objects of the invention therefore is to provide a construction assemblage which in its collapsed condition comprises a relatively small and flat package taking up very little space but which can be expanded in a multiplicity of ways, depending on the creative ability of the user, to form a wide variety of structures such as toy or play houses, castles, mazes, etc., or in larger sizes can form partitions, shelters, etc.

Among other objects of the invention is to provide a construction toy for making doll or play houses etc., or fair booths, camp shelters, stage settings, display panels, partitions, dividers, etc., with preassembled walls and roofs.

These and other objects of the invention are attained by providing a plurality of at least four rectilinear panels of approximately similar shape and size, at least three of which panels are connected together at edge portions thereof by double hinges of the Jacobs ladder type and at least an additional panel which is hinged to one of said first three panels on an axis at right angles to the double hinge of the latter. Additional panels can be hingedly connected to the outermost panels, although generally two or three separate units of a 5-panel set offer a greater variety of combinations. Each of said panels is provided with an opening adjacent each corner and reinforcing and connecting means are provided to connect panels which are not already connected and to reinforce or fix the position of adjacent panels. The reinforcing and connecting means comprises a three-fingered device made of flexible material such as box board (a suitable structure. The said three-fingered device may have a similar three-fingered device opposite the first one but may also have other connecting means extending away from the first three-fingered connection.

The double hinges connecting two adjacent panels can take the form of half panels of the same material as the panels, but pairs of double hinges can be formed of three or more hinges (e.g., a central hinge in one direction with two end hinges in the other direction can be formed); also such connections can be made smaller than half panels or one such connecting hinge can be larger than a half panel provided, of course, the other hinge is smaller than the half panel. The size and number of hinges formed on the panels can be varied to suit the material of the panels. If desired, the panels can be connected by rope or strings instead of half panels, the half panel hinge structure is being illustrated in the drawings because it appears to be vary practical one at the present time.

The panels and connectors can be formed of box board, cardboard, wood, plastic, or any other kind of sheet material suitable for construction work. A very suitable material is formed of a plastic product made in the manner that box board is made, i.e., two outer plastic sheets with a corrugated sheet of plastic therebetween. Because of its resilience and resistance to moisture, this material is especially suited for making connecting means.

The panels are also shown as square or approximately so, but generally it is only necessary that the panels be rectangular.

Other objects and advantages of the invention will be in part apparent and in part pointed out hereinafter.

In the drawing

Figure 1:
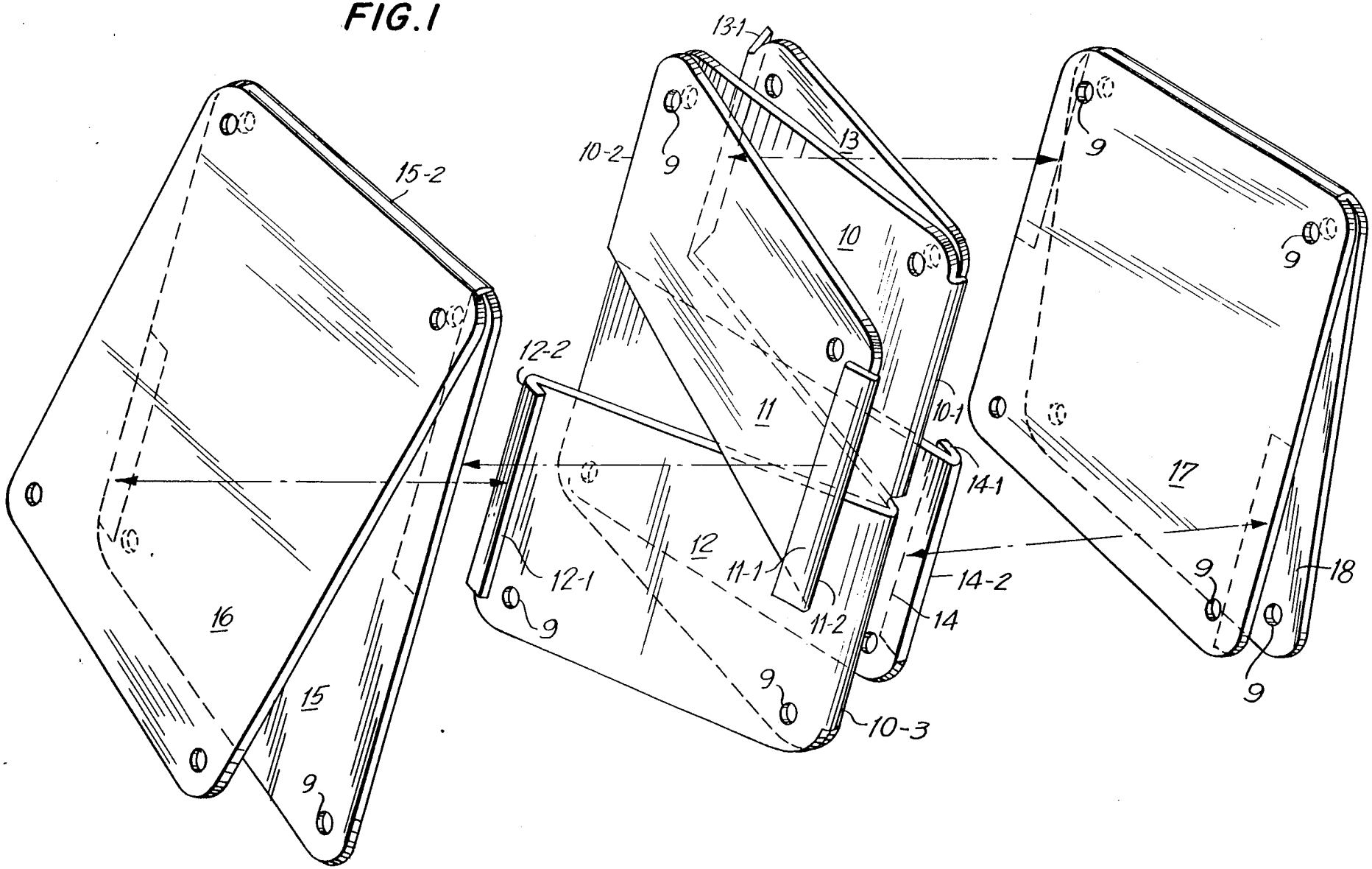
FIG. 1 is an exploded perspective view of one form of the panel structure of the invention.
Figure 1A:
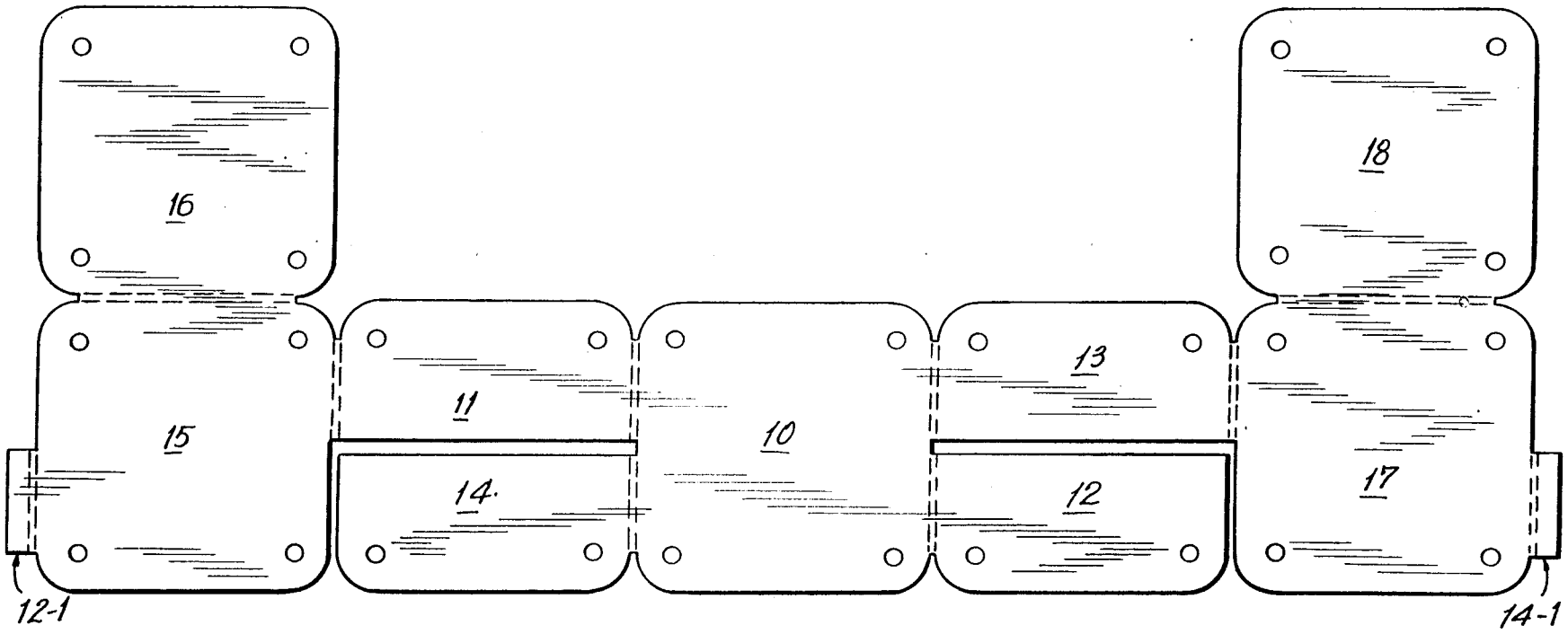
FIG. 1A is a view illustrating how the panel device of FIG. 1 can be cut in one piece.

The structural unit shown in FIGS. 1 and 1A consists of the central panel 10 to which are connected or formed unitarily therewith the double hinge 11, 12 and the double hinge 13, 14. The hinges 11, 12, 13, 14 have extensions 11-1 , 12-1, 13-1, 14-1 formed thereon for securing them to the other panels 15 or 17. If desired the extensions for uniting hinges and the outer panels can be formed on said outer panels 15 and 17. The panels 10-18 can be formed of ordinary box board with or without the corrugated inner layer so long as they can be creased or otherwise treated or connected to produce the hinge connections shown at edges 10-1, 10-2, 10-3, 11-2, 12-3, 14-2 etc. Hinge extensions 11-1, 12-1, etc. are attached to the panel 15 and hinge extensions 13-1 and 14-1 are attached to the panel 17 as illustrated by the the arrows in FIG. 1. Integrally formed with or attached to the panel 16 is panel 15 having its single hinge joint 15-2 extending at right angles to the joint formed with either part of double hinge 11-2 or 12-2. Panel 17 may have a panel 18 attached similarly.

Figure 2:
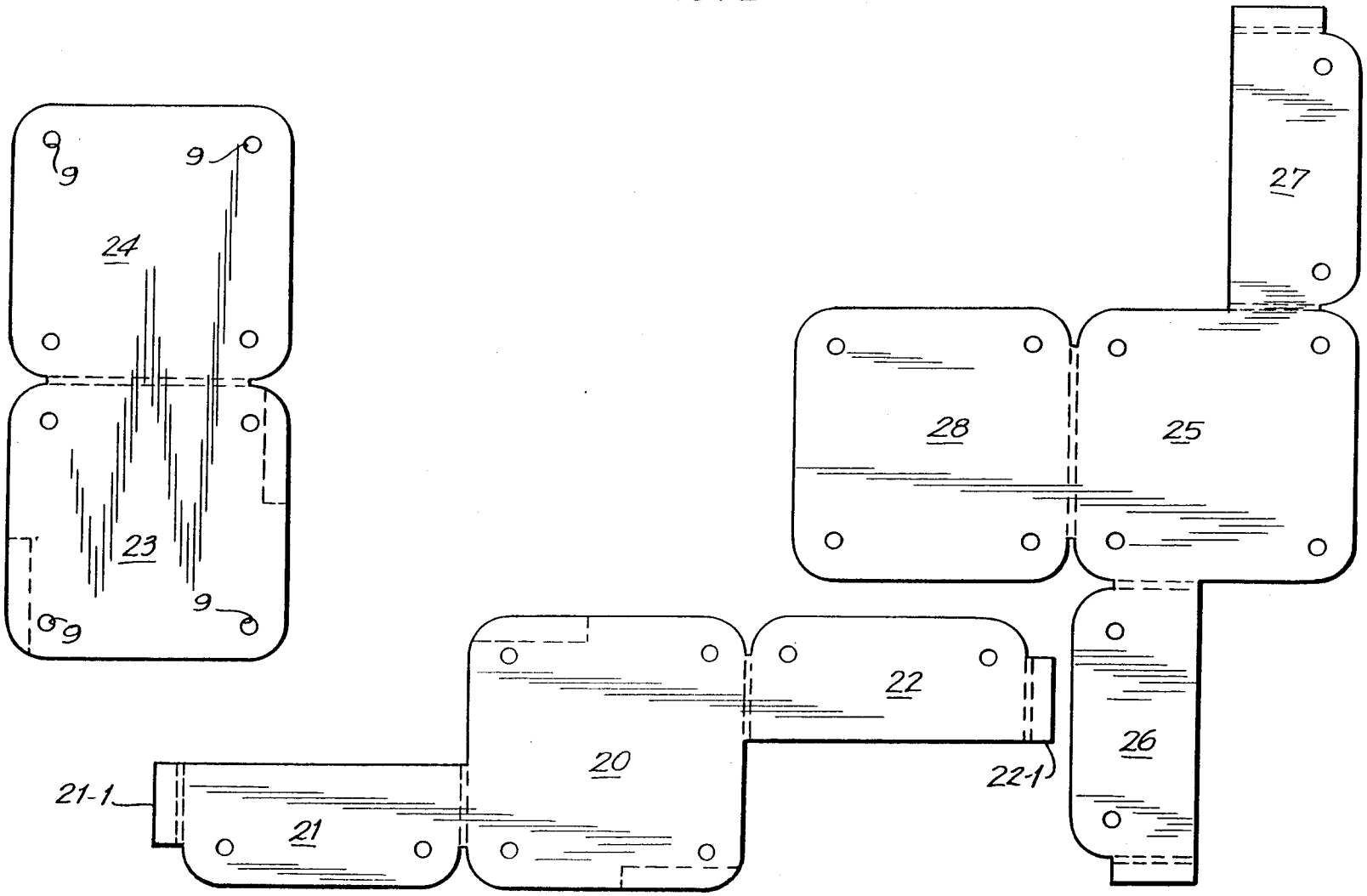
FIG. 2 is an exploded plan view of a modified form of the panel structure.
Figure 3:
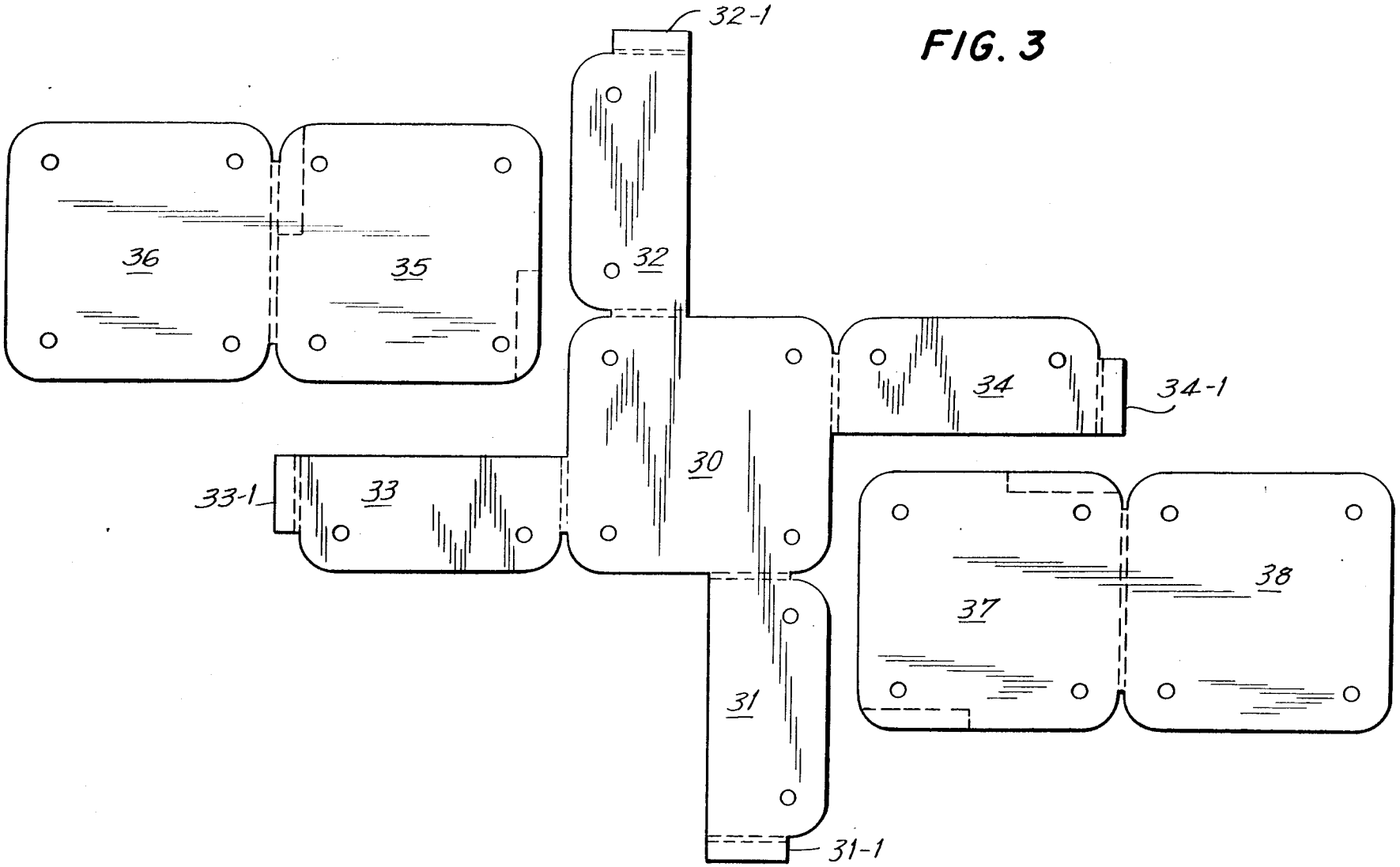
FIG. 3 is an exploded plan view of another modified form of the panel structure.
Figure 7:
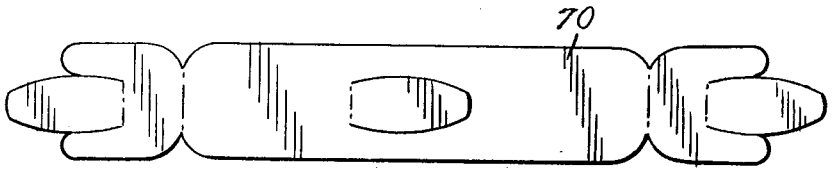
FIGS. 7 and 8 are modified forms of connecting devices.

There are a multiplicity of ways that several parts such as shown in FIG. 1 can be connected to provide double hinges in one or two directions and single hinges in one or two directions. FIGS. 2 and 3 illustrate additional ways of forming a unit from three original parts. In FIG. 2, for example, panel 20 can be the central panel with extension tabs 21-1 and 22-1 being secured to panel 23 in the space illustrated. Panel 24 then will be hinged to panel 23 at right angles to double hinge 21-22. Double hinges 26, 27 attached to panel 25 can then be connected to the free side of panel 20 in the spaces shown and in this case double hinges 26, 27 is at right angles to double hinge 21, 22. Panel 28 is also hinged to panel 25.

In the form shown in FIG. 3, the central panel 30 has double hinges 31, 32 or 33, 34 formed thereon. Extensions 33-1 and 34-1 are attached to panel 35 as shown and extensions 31-1 and 32-1 are attached to panel 37 as shown.

Figure 8:
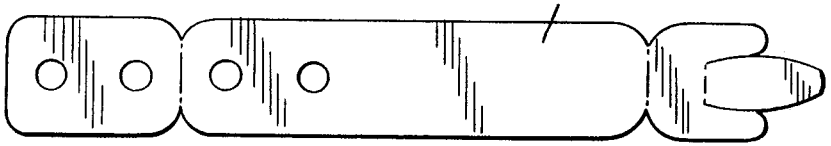
Figure 9:
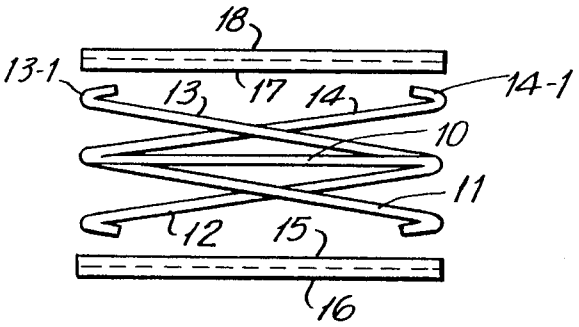
FIG. 9 is another exploded view of the unit of FIG. 1 but also illustrating how the unit is collapsed for storage or shipping.
Figure 9A:
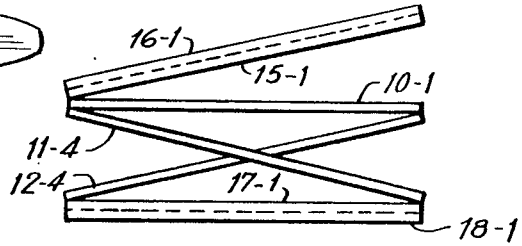
FIG. 9A is a view similar to FIG. 9 but showing only one pair of panels connected by a Jacobs ladder.

Although assemblies with two double hinges, as shown in FIGS. 1-9, have greater variability, panels with only one double hinge 11-4, 12-4, as shown in FIG. 9A, have many of the advantages of those with two double hinges.

Figure 10:
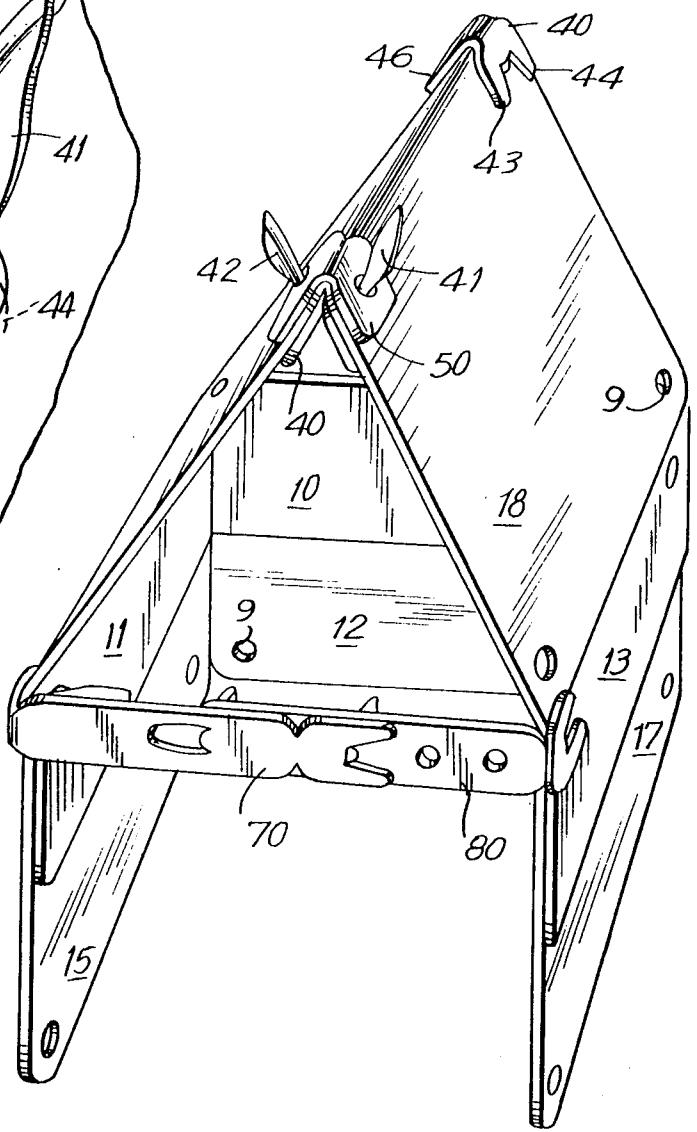
FIG. 10 is a perspective view of a house structure made from the device of FIG. 1.

FIG. 10 illustrates one of the simple structure that can be formed from the single unit of FIG. 1. In FIG. 10 the panels are numbered as in FIG. 1 so that the way the unit has been folded can be followed.

Figure 4:
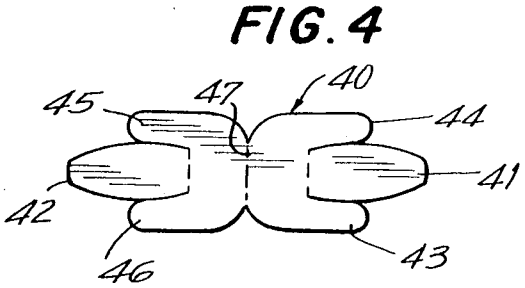
FIG. 4 is a plan view of the basic type of connecting device.
Figure 5:
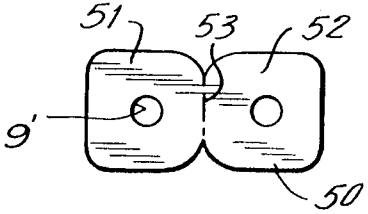
FIGS. 5 and 6 are plan views of auxiliary devices for lengthening the spacing or increasing the reinforcing of connecting devices.
Figure 11:
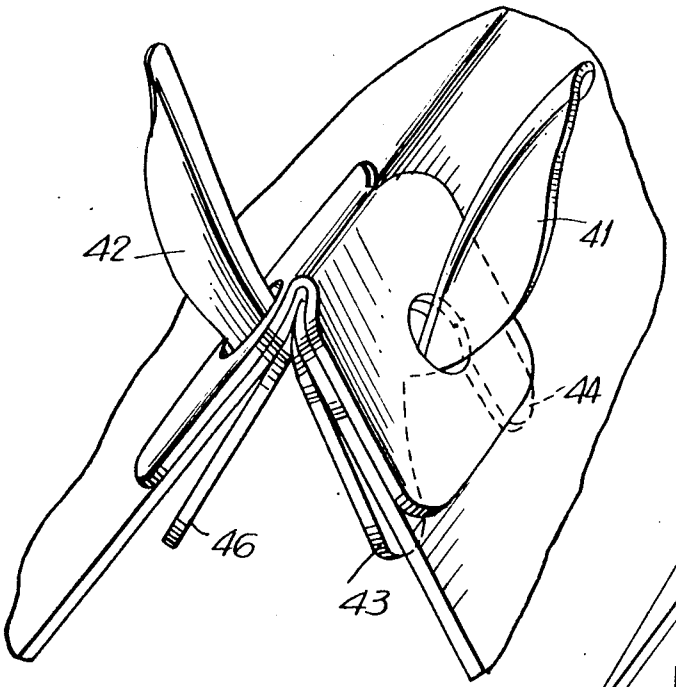
FIG. 11 is a detail view of a connection established in FIG. 9.

The structures formed from the units are reinforced to hold together at the corners by the connectors 40 such as shown in FIG. 4. Such connectors can be stamped out of box board and as shown in FIG. 4 comprise two three-fingered flat pieces connected back to back (i.e., one part is the mirror image of the other), the central fingers 41,42 thereof being ear-shaped and longer than the side fingers 43–46. The two parts are foldable along line 46. The ear-shaped central finger 41,42 is flexible and can be forced through the openings 9 formed adjacent substantially every corner of each panel. FIG. 5 shows an auxiliary reinforcing joint piece 50 comprising two similar parts 51 and 52 containing holes 9' connected along a folding joint 53. The connector 40 can unite and/or reinforce a joint in two ways as illustrated in FIG. 10. In the front part of the roof 16, 18 of FIG. 10 and as shown in greater detail in FIG. 11, the connector 40 is on the inside of the roof with the fingers 41 and 42 penetrating to the outside. The additional reinforcing means 50 has been added but could be omitted.

Figure 12:
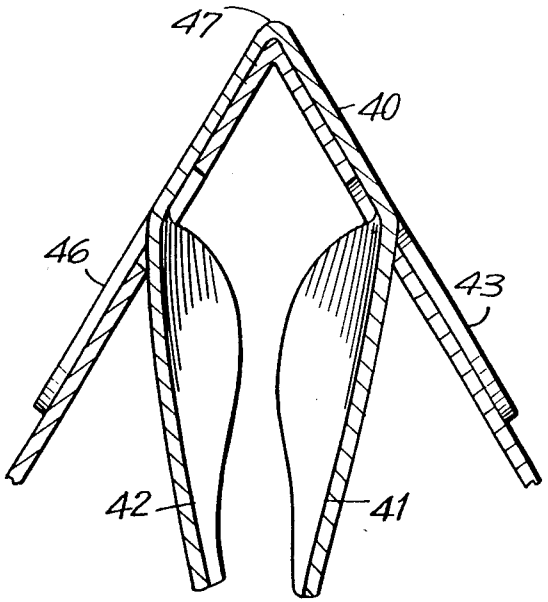
FIG. 12 is an end view of another type of connection established in FIG. 9.

In the rear part of the roof 16, 18 of FIG. 10 and as shown in detail in FIG. 12, the connector 40 is applied from the outside. It will be noted also in FIG. 10 that the fingers 43, 44, 46 as well as the finger 45 (which does not show) act to support the connector 40 against pivoting.

Figure 6:
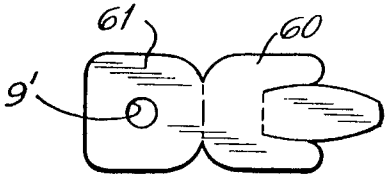

FIG. 6 shows a hybrid type of connector containing one three-fingered part 60 and one reinforcing part 61. Two of the parts 60 produce a connection similar to that of FIG. 11 with, however, one long finger extending inwardly and one extending outwardly. Also two of the connectors of FIG. 4 can be connected to different holes 9' in reinforcement 50 to build up longer connectors such as shown at 70, 80 in FIG. 10. Actually, however, the connector 70 of FIG. 7 and 80 of FIG. 8 are shown in FIG. 10.

Figure 14:
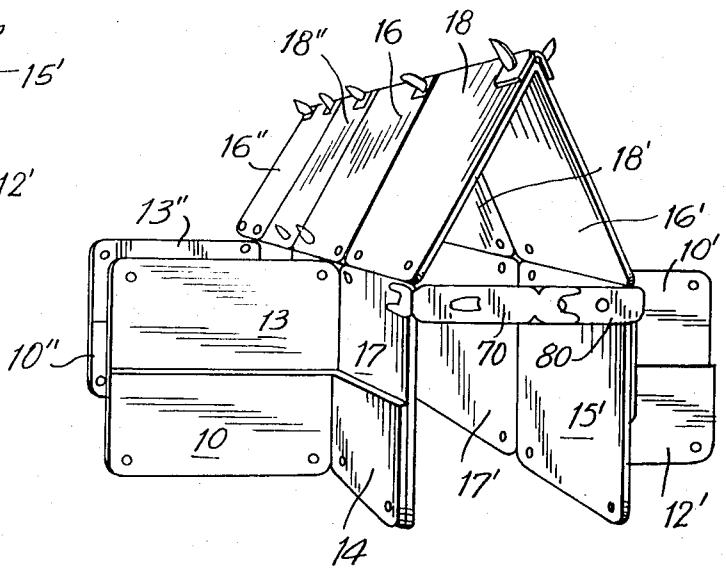
FIG. 14 is a perspective view of a covered bridge formed from several of the units such as shown in FIG. 1.
Figure 13:
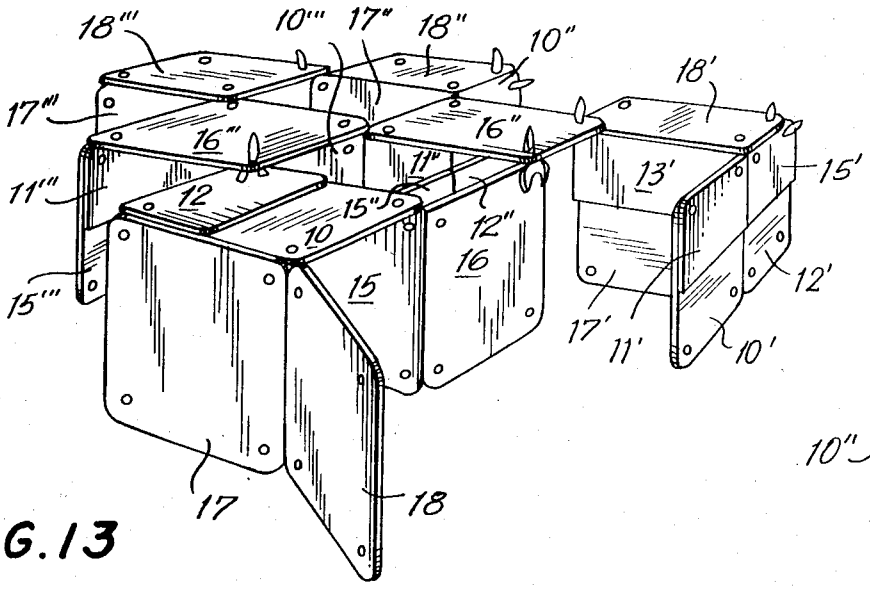
FIG. 13 is a view of a maze formed from several of the units such as shown in FIG. 1.
Figure 15:
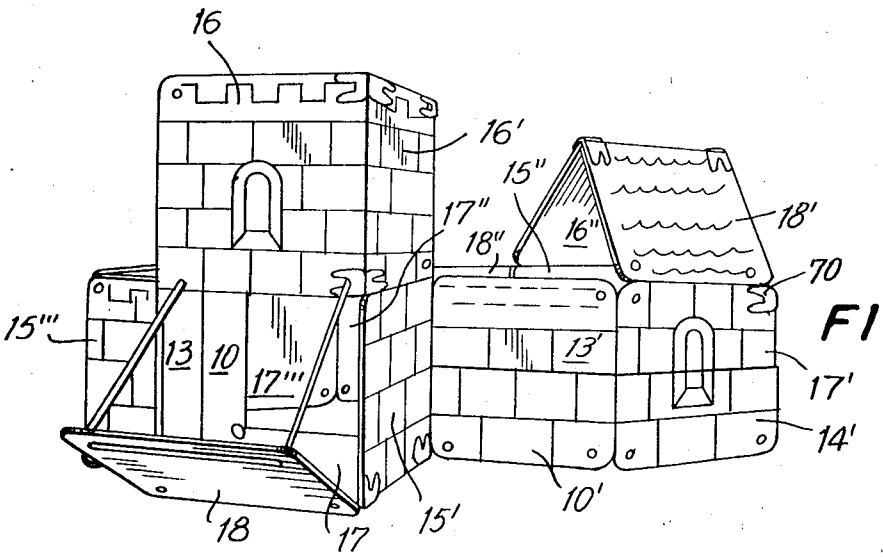
FIG. 15 is a perspective view of a castle formed from the unit of FIG. 1 and three additional units.

FIGS. 13, 14 and 15 show structures each formed from four units such as shown in FIG. 1. The numbers 10, 10', 10'', and 10''', etc. refer to corresponding panels of the four units.

I claim:

1. A construction panel system for the erection of doll and play houses, mazes, etc., comprising a series of a least four similarly shaped panels connected together so that each panel can be rotated with respect to an adjacent panel about adjacent edge portions thereof, at least three of said panels being connected at opposite edges to the adjacent panel by a double hinge of the Jacobs ladder type, at least one of said panels being substantially continuous with respect to an adjacent panel and connected thereto along a creased line forming a single hinge therebetween so that if can be rotated about an axis at right angles to axes to rotation of the double hinge, said last named panel being so constructed that it is collapsible together with the other panels one the respective hinges into a single stack having the area of approximately one panel, a plurality of edges of the various panels, including the edges of the panels with a single hinge connection, containing an opening adapted to receive fastening means for connecting two of the series of panels together, in combination with a fastening and reinforcing means comprising a two-part means, stamped or cut from planar, resilient, flexible material, a first part of said two-part means comprising two side fingers extending outwardly from an intermediate portion thereof and a central, longer and oval shaped finger extending outwardly from the intermediate portion between the two side fingers, said central finger being wider at its widest part than the openings in the edges of said panels but being sufficiently resilient and flexible to be forced through such openings, the second part of said fastener being the mirror image of said first part, whereby the edges of two panels can be connected in an abutting relation by forcing the central finger of a first part of the fastening means through one of said openings in a first panel and also forcing the central finger of the second part of the fastener through one of said openings in a second panel to be connected to the first panel.

2. A construction panel system for the erection of doll and play houses, mazes, etc. comprising a series of at least four similarly shaped panels connected together so that each panel can be rotated with respect to an adjacent panel about adjacent edge portions thereof, at least three of said panels being connected at opposite edges to the adjacent panel by a double hinge of the Jacobs ladder type, at least one of said panels being substantially continuous with respect to an adjacent panel and connected thereto along a creased line forming a single hinge therebetween so that it can be rotated about an axis at right angles to axes of rotation of the double hinge, said last named panel being so constructed that it is collapsible together with the other panels on the respective hinges into a single stack having the area of approximately one panel, a plurality of edges of the various panels, including the edges of the panels with a single hinge connection, containing an opening adapted to receive fastening means for connecting two of the series of panels together, in combination with a two-part fastening means, a first part of said two-part fastening means comprising a portion adapted to penetrate the opening in a singly-hinged panel of a first series of panels and releasably hold said panel, the second part of said two part fastening means comprising a portion adapted to penetrate the opening in a singly-hinged panel of a second series of panels whereby the edges of two singly-hinged panels of two series of panels can be connected in arbitrary relation.

* * * * *

UNITED STATES PATENT OFFICE

CERTIFICATE OF CORRECTION

Patent No. 4,635,411 Dated Jan 13, 1987

Inventor(s) Aaron Kurzen

It is certified that error appears in the above-identified patent and that said Letters Patent are hereby corrected as shown below:

Page 1, par. 2, line 3 of the paragraph (or line 8 of the page), cancel the words: "now aband."

In line 24, "struture" should be -- structure--

Signed and Sealed this

Twenty-ninth Day of March, 1988

*Attest:*

DONALD J. QUIGG

*Attesting Officer*

*Commissioner of Patents and Trademarks*